US006655405B2

(12) United States Patent
Hollister et al.

(10) Patent No.: US 6,655,405 B2
(45) Date of Patent: Dec. 2, 2003

(54) BOP OPERATING SYSTEM WITH QUICK DUMP VALVE

(75) Inventors: F. Harold Hollister, Richmond, TX (US); Jason P. Curtiss, III, Houston, TX (US); Frank B. Springett, Houston, TX (US)

(73) Assignee: Cilmore Valve Co., Houston, TX (US)

( * ) Notice: Subject to any disclaimer, the term of this patent is extended or adjusted under 35 U.S.C. 154(b) by 115 days.

(21) Appl. No.: 09/910,245

(22) Filed: Jul. 20, 2001

(65) Prior Publication Data

US 2002/0100501 A1 Aug. 1, 2002

Related U.S. Application Data

(60) Provisional application No. 60/265,444, filed on Jan. 31, 2001.

(51) Int. Cl.[7] ..... F16K 11/10
(52) U.S. Cl. ..... 137/102; 251/1.1
(58) Field of Search ..... 137/102, 111, 137/112, 113; 251/1.1

(56) References Cited

U.S. PATENT DOCUMENTS

| | | | | |
|---|---|---|---|---|
| 776,061 A | | 11/1904 | Hewett | |
| 1,529,384 A | | 3/1925 | Adams | |
| 1,686,310 A | | 10/1928 | Beebe | |
| 1,754,975 A | | 4/1930 | Andersen | |
| 1,795,386 A | | 3/1931 | Beebe | |
| 2,197,455 A | | 4/1940 | Volpin | |
| 2,318,962 A | | 5/1943 | Parker | |
| 2,335,814 A | | 11/1943 | Stevenson | |
| 2,358,228 A | | 9/1944 | Hoof | |
| 2,408,799 A | | 10/1946 | Melichar | |
| 2,445,505 A | | 7/1948 | Ashton | |
| 2,551,045 A | | 5/1951 | Parker | |
| 2,605,080 A | | 7/1952 | Rea | |
| 2,634,743 A | | 4/1953 | Audemar | |
| 2,651,491 A | | 9/1953 | Ashton et al. | |
| 2,654,564 A | | 10/1953 | Pech | |
| 2,685,295 A | | 8/1954 | Tromp | |
| 2,811,979 A | | 11/1957 | Presnall | |
| 3,038,487 A | * | 6/1962 | Gardner | 137/112 |
| 3,454,029 A | | 7/1969 | Fredd | |
| 3,529,624 A | | 9/1970 | Cryder et al. | |
| 3,533,430 A | | 10/1970 | Fredd | |
| 3,533,431 A | | 10/1970 | Kuenzel et al. | |
| 3,550,611 A | | 12/1970 | Baatrup | |
| 3,805,825 A | * | 4/1974 | Lovingham | 137/512 |
| 4,147,221 A | * | 4/1979 | Ilfrey et al. | 175/7 |
| 4,176,986 A | * | 12/1979 | Taft et al. | 405/211 |
| 4,253,481 A | | 3/1981 | Sarlls, Jr. | |
| 4,467,825 A | | 8/1984 | Boyd | |
| 4,936,334 A | * | 6/1990 | Hendershot | 137/112 |
| 5,012,854 A | * | 5/1991 | Bond | 166/363 |
| 5,234,031 A | * | 8/1993 | Pickett et al. | 137/112 |
| 6,044,690 A | * | 4/2000 | Williams | 73/40.5 R |

* cited by examiner

*Primary Examiner*—John Rivell
*Assistant Examiner*—Ramesh Krishnamurthy
(74) *Attorney, Agent, or Firm*—Blackwell Sanders Peper Martin LLP

(57) ABSTRACT

In some prior art Blowout Preventer (BOP) operating systems, high velocity fluid flows and low differential pressures induced vibration in the system. This vibration may result in collapse and failure of hydraulic hoses in the system. A quick dump valve has been added at or near the open port on the BOP assembly to reduce vibration and other problems. The dump valve has a vent position and an open position. Several alternative embodiments add a ball check valve assembly to the shuttle in the quick dump valve.

6 Claims, 6 Drawing Sheets

FIG. 4

BOP OPERATING SYSTEM WITH QUICK DUMP VALVE

CROSS-REFERENCE TO RELATED APPLICATION

This application contains some common subject matter with U.S. Provisional Application Ser. No. 60/265,444. As to this common subject matter, Applicants claim benefit of the provisional patent application filed on Jan. 31, 2001, Ser. No. 60/265,444.

BACKGROUND OF THE INVENTION

1. Field of the Invention

Drilling rigs use blowout preventers (BOPs) to shut in a well during emergencies and for other purposes. The BOP operating system needs to be reliable in order to protect lives, the environment, and property. This invention relates to an improved BOP operating system and a quick dump valve. The quick dump valve includes a shuttle that has some structural similarity to shuttle valves used for control functions in prior art BOP operating systems. Specifically, the quick dump valve has some structural similarities to the Low Interflow Hydraulic Shuttle Valve which is the subject of a pending U.S. patent application Ser. No. 09/452,594 filed on Dec. 1, 1999 and a pending U.S. patent application Ser. No. 09/653,415 for a Pressure Biased Shuttle Valve filed on Sep. 1, 2000, both of which are incorporated herein by reference. Gilmore Valve Co. is the owner of these two pending U.S. Patent Applications, the present patent application for BOP Operating System with Quick Dump Valve and other U.S. patents for shuttle valves including U.S. Pat. Nos. 3,533,431 and 4,253,481. However, the present invention is structurally distinct from these prior art shuttle valves and it performs a different function as discussed below.

2. Description of the Prior Art

Subsea wellhead systems are often relied upon during deep-water exploration for oil and natural gas. The subsea wellhead system includes a stack of BOPs. Annular BOPs are actuated on a routine basis to snub or otherwise control pressure during normal drilling operations. Other blowout preventers, such as blind rams, pipe rams, and shear rams will also be included in the stack on the subsea wellhead. When these types of rams are actuated, operations in the well cease in order to control pressure or some other anomaly. Blind rams, pipe rams, shear rams and annular preventers are periodically functioned and tested to make sure that they are operational.

BOPs are tested periodically to ensure that they will function in emergencies and in other situations. Prior art subsea BOP operating systems include control pods, the lower marine riser package (LMRP), the BOP stack and interconnecting hoses and pipes. From time to time it may be necessary to perform an emergency disconnect of the LMRP from the BOP stack, for example, if a drill ship drifts off station or if a storm approaches. If it is necessary to make an emergency disconnect of the LMRP from the BOP stack, it will be necessary to close the shear rams. During the closing sequence, hydraulic fluid is forced through pipes or hose, a shuttle valve and additional segments of pipes or hose before it finally reaches the directional control valve vent port on the control pod where it is vented to the ocean. This circuitous hydraulic vent path results in a high differential pressure, which decreases flow of control fluid through the close side of the operating system. The decreased flow consumes valuable seconds, and as such, increases the time required to close the shear rams and disconnect the LMRP from the BOP stack. In prior art BOP operating systems, pilot operated check valves or conventional sub-plate mounted (SPM) poppet valves were used to vent this fluid during the closing sequence. These prior art vent devices rely upon springs or pilot pressure to operate properly.

The present dump valve for use in the improved BOP operating system utilizes a ported shuttle that automatically shifts with the direction of hydraulic pressure to either expose or seal the vent port in the valve. The present dump valve has two positions—vent and open. It has several advantages over the prior art due to its location in the BOP operating system and its design. These advantages occur when the valve is in both the vent and the open positions as discussed below. The present dump valve is a much simpler design than the prior art pilot operated check valves and conventional SPM valves.

The present dump valve and improved BOP operating system are designed to reduce hydraulic shock and vibration, to reduce the incidence of hose collapse on both the close side and the open side of the system, to facilitate installation and maintenance, and to shorten the emergency disconnect sequence of the LMRP from the BOP stack. In some prior art systems, hydraulic shock and vibration would sometimes accompany the closing function.

In the improved BOP operating system the dump valve of the present invention is located at or near the open port of the BOP. During the closing sequence in the improved BOP operating system, the present dump valve is shifted to the vent position. In this position fluid is vented from the BOP operating system. When it is time to open the shear rams, fluid flow reverses through the dump valve and it moves to the open position. In the open position, the vent is closed allowing fluid to move through the open port into the BOP to open the rams.

Some BOP hoses may collapse in deep water when subjected to high velocity flows of hydraulic fluid resulting from functioning of the BOPs with large capacity operators. Hose collapse is, of course, undesirable. The present dump valve and the improved BOP operating system are designed to reduce flow velocities in the control system, and thereby reduce the incidence of BOP control hose collapse. In the improved BOP operating system, the dump valve is positioned at or near the open port on the BOP to vent fluid from the system during the closing sequence. Because the dump valve is located at or near the open port on the Ram's BOP, this high velocity fluid is vented and does not pass through the open side hose. The control hoses on the open side of the BOP will, therefore, be less prone to collapse because they are no longer exposed to the hydraulic shock and negative pressure waves caused by high velocity flow of fluid when the BOP rams are being closed.

When the rams are being opened, the dump valve also acts as a dampener to reduce the incidence of hose collapse on the close side of the operating system. In a preferred embodiment, when the rams are functioned open, fluid passing through the dump valve is restricted because the orifice through the dump valve is smaller than the inside diameter of the hose leading to and exiting from the dump valve. This flow restrictor will effectively slow down the velocity of the fluid entering the BOP rams. In turn, the velocity of the exhausting fluid from the close side will be reduced to a rate that reduces hydraulic shock and therefore reduces the incidence of hose collapse. In some prior art BOP operating systems, it may take as much as 20 seconds to close and open the rams. The improved BOP operating system with quick dump valve should allow the rams to close in approximately 5 to 15 seconds; however, it may take more than 30 seconds for the rams to open.

Maintenance on prior art BOP operating systems is sometimes lengthy and expensive. The present dump valve is smaller and lighter than conventional SPM valves or pilot operated check valves, which will facilitate valve installation reliability and maintenance.

The improved BOP operating system with quick dump valve should reduce the amount of time it takes to make an emergency disconnect of the LMRP from the BOP stack. In prior art BOP operating systems when it was necessary to close the rams, fluid was forced through a length of hydraulic hose, a shuttle valve and additional segments of tubing or hose before it finally reached the directional control valve vent port on the control pod. This circuitous hydraulic vent path on the close side of prior art operating systems results in a high differential pressure, which decreases flow of control fluid when the rams are being closed. The decreased flow consumes valuable seconds and, as such, increases the time required to close the rams and disconnect the LMRP from the BOP stack. Positioning the quick dump valve at or near the BOP Ram's open port will substantially shorten the hydraulic vent path and reduce the differential pressure. All of these features will reduce the amount of time required to close the BOP rams during an emergency and thus speed up the disconnect of the LMRP from the BOP stack.

SUMMARY OF THE INVENTION

The quick dump valve uses a ported shuttle design that shifts to either expose or seal off the vent port in the valve. When the BOP is being closed, the shuttle moves to the vent position allowing fluid to be vented from the improved operating system. This vent function which is located at or near the BOP prevents high velocity fluid from passing through the open side hose thus reducing the incidence of hydraulic shock, vibration and hose collapse.

When the BOP is being opened, the shuttle in the dump valve moves to the open position allowing fluid to pass through the dump valve and into the BOP. A flow restrictor is positioned in the shuttle, which acts as a dampener to reduce hydraulic shock, vibration and the incidence of hose collapse on the close side of the BOP rams. While the BOP is being opened, it is important that the shuttle achieve a good seal to prevent fluid from escaping to vent. The diameter on the supply side of the shuttle is larger than the diameter on the BOP side which results in more force being applied to the seals to prevent unwanted fluid from escaping to vent while the BOP is being opened.

In some situations, it is desirable to prevent fluid from flowing to supply when fluid is escaping to vent while the BOP is being opened. In the first alternative embodiment, a ball check valve, is positioned in the shuttle to block fluid flow from the BOP to supply when the dump valve is in the vent position. In the first alternative embodiment, the diameter on the supply side of the shuttle is larger than the diameter on the BOP side, which results in more force being applied to the seals to prevent unwanted fluid from escaping to vent while the BOP is being opened.

In the second alternative embodiment, a ball check valve is positioned in the shuttle to block fluid flow from the BOP to supply when the dump valve is in the vent position. In the second alternative embodiment, the diameter on the supply side of the shuttle is the same diameter as in the BOP side. The cracking pressure of the check valve results in the differential pressure and force required to energize the metal to metal face seal. Differential area was utilized to accomplish this in the alternative and first alternative embodiment.

In the third alternative embodiment, there is no internal check valve and the diameter on the supply side of the shuttle is the same diameter as on the BOP side. In the third alternative embodiment soft seals are used on both sides of the shuttle to achieve a seal. These seals may be located in either the shuttle or adapters.

BRIEF DESCRIPTION OF THE DRAWINGS

In order to more fully understand the aforementioned features, advantages and objects of the present invention, a more detailed description of the invention is provided in the appended drawings. It is noted, however, that the appended drawings illustrate only a typical embodiment of this invention and are therefore not to be considered limiting of its scope, for the invention may admit to other equally effective embodiments. Reference the appended drawings, wherein.

DESCRIPTION OF THE PREFERRED EMBODIMENT

The quick dump valve uses a ported shuttle design that shifts to either expose or seal off the vent port in the valve. When the BOP is being closed, the shuttle moves to the vent position, allowing fluid to be vented from the improved operating system. This vent function which is located at or near the BOP prevents high velocity fluid from passing through the open side hose, thus reducing the incidence of hydraulic shock, vibration and hose collapse.

Control pods, attached to the LMRP, direct hydraulic operating fluid to all the functions on the BOP and LMRP. The LMRP is positioned on the BOP stack. BOP control systems have two (2) redundant hydraulic systems commonly referred to in the industry as blue and yellow pods.

Figure 1:
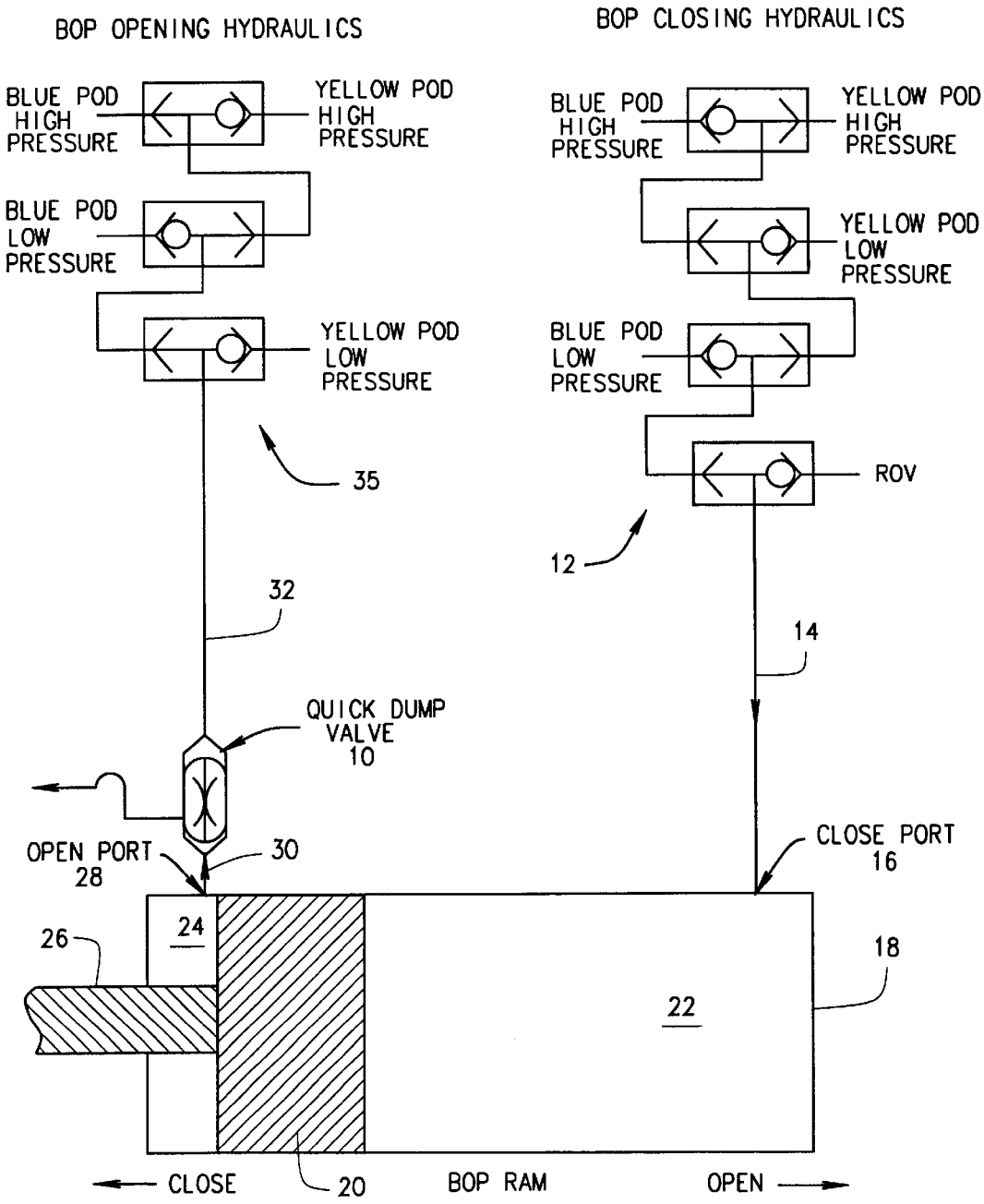
FIG. 1 is a hydraulic circuit showing the BOP rams in the closed position and the quick dump valve of the present invention in the vent position.

FIG. 1 is a hydraulic circuit diagram of a portion of the improved BOP operating system with the quick dump valve 10 positioned at or near the open port on the BOP. In FIG. 1, fluid flows from the yellow pod hydraulic supply through valves on the control pod through the shuttle valve generally identified by the numeral 12 through hoses 14 as identified by the flow arrow to the close port 16 in the BOP assembly 18. This side of the operating system is referred to as the close side of the system because fluid flows into this side when the rams are functioned close. A piston 20 divides the BOP assembly 18 into a close chamber 22 and an open chamber 24. A rod 26 extends from the piston 20 to the BOP rams.

The open chamber 24 connects to an open port 28, which connects to a short conduit 30, which connects to the quick dump valve 10. Alternatively, the dump valve 10 can be directly connected to the open port 28. Additional hoses 32 connect the dump valve 10 to one of three ports on the shuttle valve generally identified by the numeral 35. The other two ports on the shuttle valve 35 connect to the blue pod and the yellow pod hydraulic supply as well known to those skilled in the art. When hydraulic fluid is directed from either the blue or yellow pods, the shuttle valve 35 seals off the path of the non-energized hydraulic system and routes the fluid to the BOP.

In order to open the rams as shown in FIG. 1, high pressure fluid exits from a pod, in this case the yellow pod, and moves through the shuttle valve 12, the conduit 14, the close port 16 and enters the close chamber 22 thus moving the piston 20 to the left-hand side of the BOP assembly 18 as shown in FIG. 1. As high-pressure fluid enters the close chamber 22, fluid must exit the open chamber 24. As the piston 20 moves to the closed position, the fluid in the open chamber 24 moves into the dump valve 10, shifting it to the vent position (FIG. 4) thus venting the fluid to sea. During the closing process fluid is being vented through the dump valve 10. After the BOP is closed, the pressure in the close chamber 24 equalizes and no further fluid is vented. However, the shuttle 36 in the dump valve 10 remains in the vent position until the BOP is opened. During vent flow the majority of the fluid exhausts through the vent port 44 of the dump valve 10. A small portion of fluid, between 10 to 20%, flows through the flow restrictor passage 82 in the shuttle, and back through the shuttle valves 35 where it exhausts to the ocean (via components not shown in FIG. 1). Because the flow rate back through the shuttle valves is greatly reduced, energy which can trigger vibration or oscillation is also low. As an alternative configuration a check valve can be employed in the inside of the dump valve 10 to totally eliminate this flow.

The BOP assembly 18 operates with fluids that are flowing as fast as 320 gpm at pressures of 1500 to 3000 psi. These high pressures and high flow rates sometimes create hydraulic shock and vibration in the BOP operating system generally shown in FIG. 1. Prior art SPM's and pilot operated check valves are sometimes installed in "Tee" connections located near the BOP on both the opening and closing sides. These valves are actuated by external means to vent return flow to the ocean. This is similar to the function performed by the dump valve 10, however, the dump valve 10 is a much simpler device containing fewer moving parts, and therefore improved reliability. Also due to the greater size of the prior art SPM's and pilot operated check valves, they must be mounted in the BOP frame or other structure which is a greater distance away than the location of the present dump valve 10, increasing the resistance to vent flow. In the improved operating system of FIG. 1, the dump valve 10 is installed at the open port 28 or in close proximity thereto by conduit 30. When the BOP is closed as shown in FIG. 1, the dump valve 10 is in the vent position allowing fluid from the close chamber 24 to vent from the operating system. This reduces hydraulic shock and vibration and the incident of hose collapse on the open side of the operating system. The improved BOP operating system of FIG. 1 with the quick dump valve 10 allows the BOP rams to be closed more quickly than most prior art systems because the fluid from the open chamber 24 is vented from the system at or near the open port 28. Some prior art systems took up to 20 seconds to close. The present invention should be able to close in 5–15 seconds.

The dump valve 10 is smaller and lighter than conventional SPM or pilot operated check valves which should facilitate installation and maintenance on the improved BOP operating system. The dump valve 10 is a simpler more reliable design than prior art SPM and pilot operated check valves.

Figure 2:
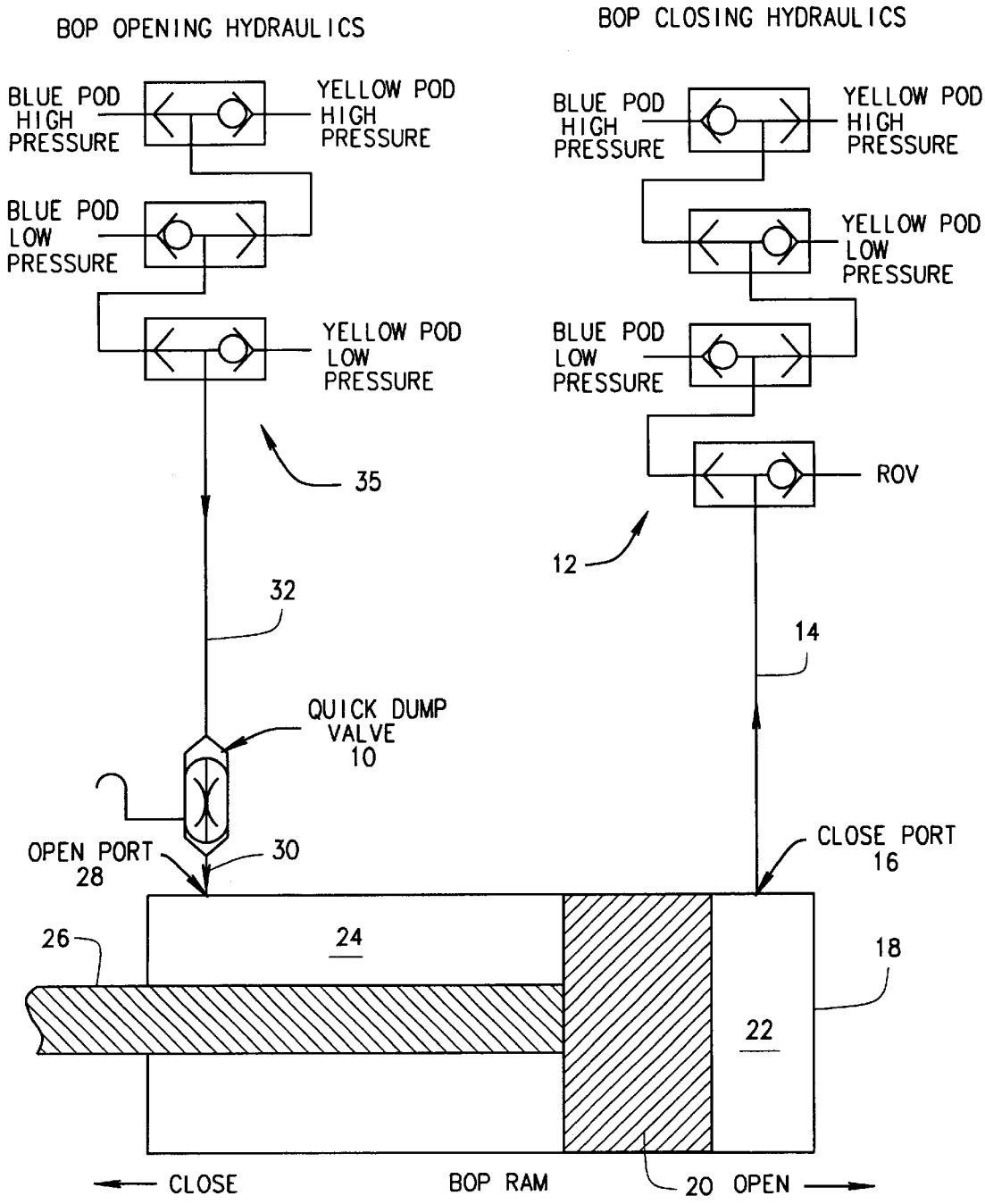
FIG. 2 is a hydraulic circuit showing the BOP rams in the open position and the dump valve of the present invention in the open position.

FIG. 2 is a partial hydraulic circuit diagram portion of the improved BOP operating system. In order to open the BOP rams, high pressure fluid flows from the blue pod hydraulic supply through the shuttle valve 35 through the piping and/or hose 32 and enters the dump valve 10. The velocity of this fluid causes the dump valve to move from the vent position of FIG. 4 to the open position of FIG. 5. In the open position, fluid passes through a flow restrictor in the dump valve 10 to the open port 28 and into the open chamber 24. This causes the piston 20 to move towards the right-hand side of the drawing, which retracts the rod 26 thus opening the BOP. As the piston 20 moves from the full closed position of FIG. 1 to the full open position, fluid in the closed chamber 22 moves through the close port 16 and the hose 14 on the close side of the BOP operating system. In order to dampen hydraulic shock, the present invention will take more than 30 seconds to open, but this is acceptable because the open function does not occur under emergency conditions.

Figure 3:
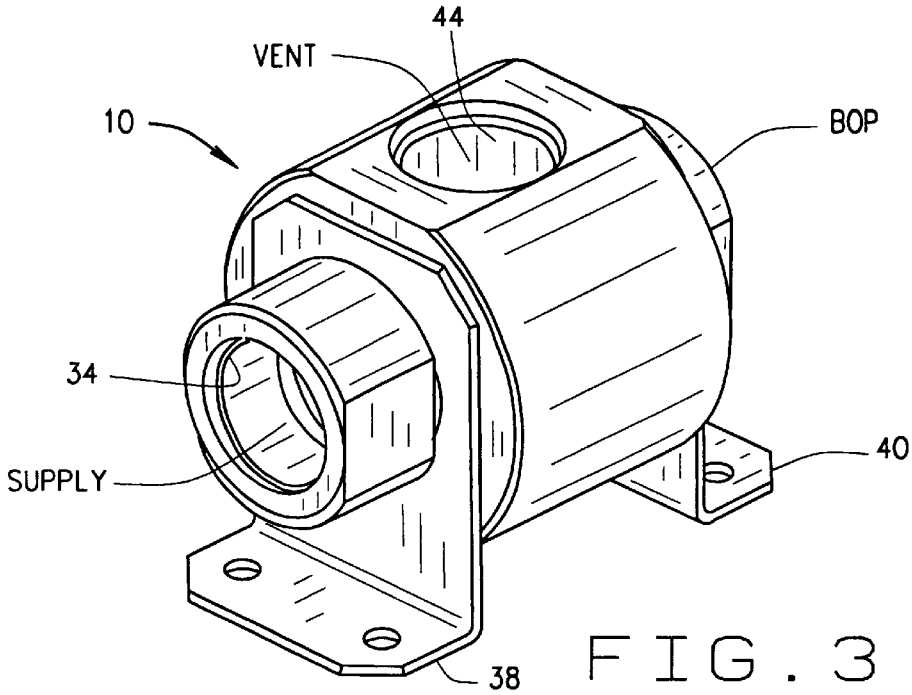
FIG. 3 is a perspective view of a preferred embodiment of the quick dump valve of the present invention.

FIG. 3 is a perspective view of the dump valve 10, which is supported by brackets 38 and 40. The dump valve 10 has a supply port 34, which connects to the hose 32 on the open side of the operating system. A BOP port 42 connects to the hose 30 or directly to the open port 28. A vent port 44 is connected to conduits, which are vented to sea.

Figure 4:
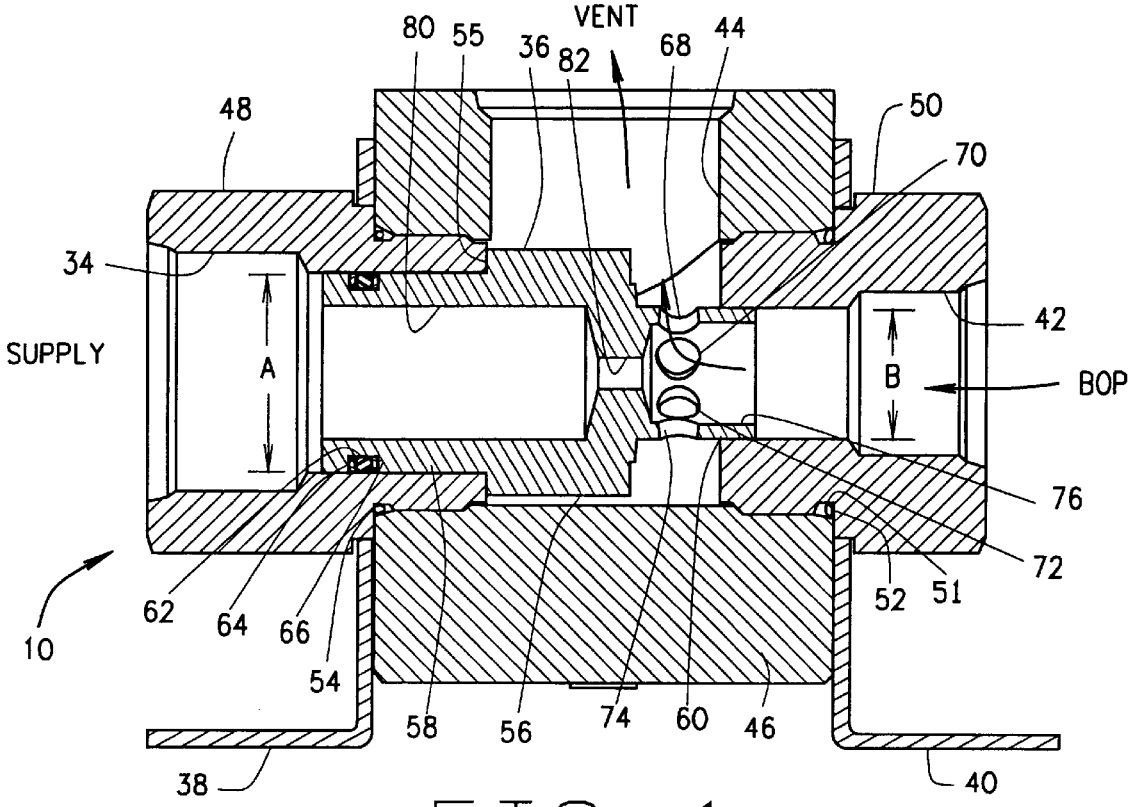
FIG. 4 is a section view of the quick dump valve of FIG. 3 in the vent position with flow arrows showing the direction of fluid flow from the BOP through the dump valve and out the vent.

FIG. 4 is a section view of the dump valve 10 in the vent position. In this position, fluid moves from the open chamber 24, through the valve 10 and is vented to sea. When the shuttle 36 is in the vent position fluid flows through the dump valve 10 as shown by the flow arrows in the drawing. Fluid enters the dump valve 10 through the BOP port 42 and exits through the vent port 44 as shown by the flow arrows. The body 46 has a longitudinal bore that is threaded to receive the supply adapter 48 and the BOP adapter 50. An O-ring 52 is positioned in channel 51 and between the body 46 and the BOP adapter 50 thus creating a seal between these two components. Another O-ring 54 is positioned between the supply adapter 48 and the body 46 to create a seal between these two components. The body also has a transverse bore which forms the vent port 44 and which connects to the longitudinal bore.

Figure 5:
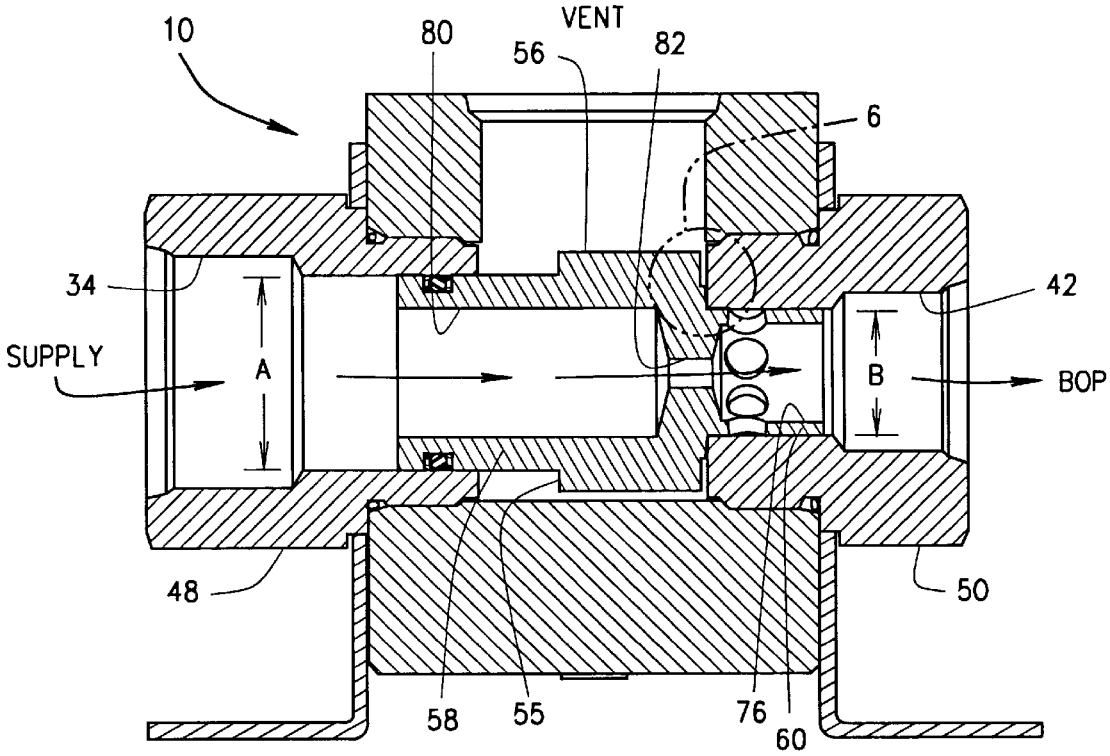
FIG. 5 is a section view of the dump valve of FIG. 3 in the open position with flow arrows showing the flow of fluid from supply through the dump valve through the BOP.
Figure 6:
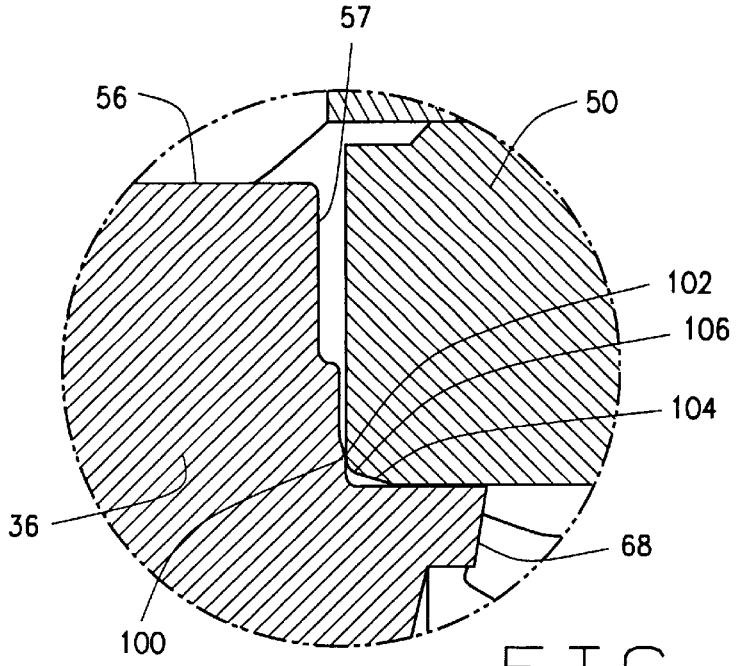
FIG. 6 is an enlargement of the metal to metal seal 6 shown in FIG. 5.

The shuttle 36 has a central radial collar 56 and opposing end portions 58 and 60. The diameter, identified by the arrow A, of the end portion 58, is larger than the diameter, identified by the arrow B, of the end portion 60. This step in diameter produces greater area on the supply end 58. When the shuttle 36 is in the open position shown in FIG. 5, and the BOP piston 20 has reached full travel stopping flow and equalizing the pressure across the shuttle, a difference in force is created by this greater area on the supply end holding the shuttle in the open position and effecting a metal to metal seal as shown in FIGS. 5 and 6. The area of the end portion 58 should be larger than the area of the end portion 60 to ensure a good seal. Applicants have determined that a good seal can be achieved if the area of end portion 58 is approximately 1.5 times greater than the area of the end portion 60; however other area ratios may be suitable, provided that a good seal is achieved when the valve 10 is in the open position as shown in FIGS. 5 and 6.

The end portion 58 has an O-ring groove 61 formed therein. An O-ring 62 and a first backup ring 64 and a second backup ring 66 are positioned in the O-ring groove 61. The O-ring can be formed from conventional materials such as nitrile rubber provided that they will meet operational temperatures in the subsea environment. The backup rings are typically produced from polymers such as Delrin® or Teflon®.

The end portion 60 includes a plurality of apertures 68, 70, 72, 74 and others not shown. These transverse apertures connect with a bore 76 to allow fluids to flow through the dump valve 10 to the vent port 44 as shown by the flow arrows in FIG. 4. Fluids flow from the open chamber 24 to the open port 28, through the conduit 30 to the BOP port 42 through the bore 76, and the plurality of apertures 68, 70, 72 and 74 to the vent port 44 and hence to sea.

A bore 80 is formed in the longitudinal axis of the end portion 58 of the shuttle 36. A flow restrictor 82 allows fluid communication between the bore 80 and the bore 76 better seen in FIG. 5.

FIG. 5 is a section view of the dump valve 10 in the open position allowing fluid to flow through the dump valve 10 to the open chamber 24 of the BOP assembly 18 as shown by the flow arrows. Fluid enters the supply port 34, passes through the bore 80, the flow restrictor 82, the bore 76, the BOP port 42 and thereafter flows into the open chamber 24 in the BOP assembly 18 as better seen in FIG. 1. For a one inch dump valve, applicants have determined that a flow restrictor with an I.D. of from 0.156 to 0.375 inches is suitable. The 0.156 inch I.D. flow restrictor allows a flow rate of 20 gpm at 1500 psi differential pressure.

The shuttle 36 is typically located in one of two positions. The vent position is shown in FIG. 4 and the open position is shown in FIG. 5. When the shuttle is in the vent position of FIG. 4 the shoulder 55 abuts the supply adapter 48. When the shuttle 36 is in the open position of FIG. 5, the end portion 58 of shuttle 36 is in sealing engagement with the supply adapter 48 and the end portion 60 of shuttle 36 is in sealing engagement with the BOP adapter 50. Various types of seals could be used to accomplish a seal between the end portion 58 and the adapter 48 and the end portion 60 and the adapter 50, including metal to metal seals or soft seals. It is important that the seals utilized withstand the high pressures and flow velocities encountered in this application. It is important that the shuttle 36 achieve a seal with the adapter 48 and adapter 50 when the shuttle is in the open position as shown in FIG. 5. Otherwise hydraulic fluid will bleed out the vent and slow down or thwart efforts to open the BOP rams. Likewise a good seal between the shuttle 36 and the adapter 48 and adapter 50 is important when the valve 10 is in the vent position.

FIG. 6 is an enlarged section view of the end portion 60 of the shuttle 36 and a portion of the BOP adapter 50 using metal to metal seals. Again, other types of seals may be suitable for this valve and the selection of metal to metal seals is a manufacturing choice. The shuttle 36 includes a circumfrential flange 56 with a shoulder 57 which is a part of end portion 60. An outwardly tapered metal sealing surface 100 is formed on the shoulder 57. Applicants believe that a taper of approximately 8° is optimum for this application. However, other tapers in the range of 5–15° may also be effective so long as they create a coining effect on the metal valve seat 102 of the supply adapter 50. The only requirement for the angle of taper is to achieve coining and therefore sealing between the sealing surface 100 and the metal valve seat 102. FIG. 6 shows the sealing surfaces after the dump valve 10 has been manufactured but before any coining has occurred.

The adapter 50 includes a chamfer 104 recessed behind the metal valve seat 102 to thereby create an obtuse metal point 106 that will contact the tapered metal sealing surface 100 on the flange 56 of the shuttle 36. Coining occurs when the shuttle moves back and forth from the vent to the open positions. As the shuttle moves back and forth, the tapered metal sealing surface 100 impacts the point 106 and metal it displaced from the point 106 to the chamfer 104. This displacement of metal is referred to as coining.

FIG. 6 shows the metal valve seat 102 and the metal sealing surface 100 on the end portion 60 of shuttle 36 before any coining has occurred. Applicant uses a chamfer with a 15° angle and a 0.015 inch radius. However, the exact size and depth of the chamfer are not particularly critical because this is merely a recess or space into which displaced metal will move due to progressive coining. A step back shoulder or other recess in lieu of the chamfer may also prove effective provided that there is room to receive the displaced metal from the point 106 such that it does not interfere with movement of the shuttle 36.

After the shuttle 36 has moved back and forth on several occasions, the metal sealing surface 100 of the shuttle 36 impacts the point 106 of the metal valve seat 102, and a portion of the metal in the point 106 is displaced into the chamfer 104. A metal to metal seal is therefore achieved between the metal valve seat 102 and the outwardly tapered metal sealing surface 100 of the flange 56 on the shuttle 36.

Figure 7:
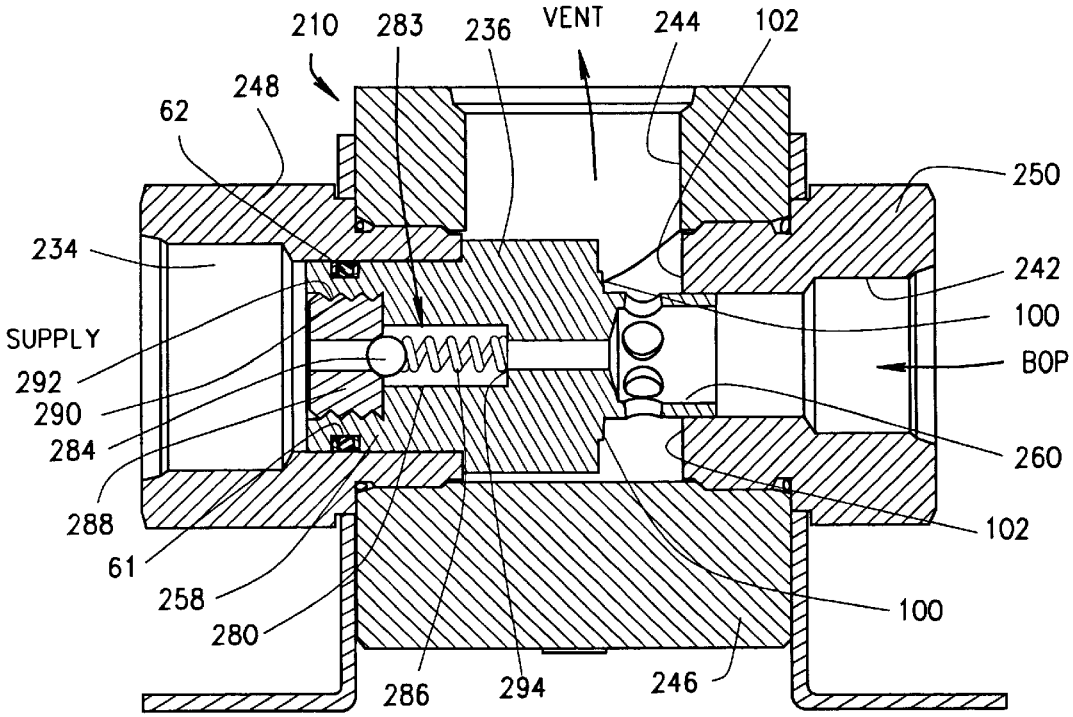
FIG. 7 is an alternative embodiment of the dump valve of the present invention including a ball check valve. This ball check valve eliminates all return flow through the supply side hydraulics during venting. The supply side of the shuttle has a larger diameter than the BOP side.

FIG. 7 is an alternative embodiment of the dump valve in the vent position. The valve 210 is constructed in a manner similar to the valve of FIG. 4 and includes a body 246 defining a vent port 244, a BOP adapter 250 defining a BOP port 242 and a supply adapter 248 defining a supply port 234. The shuttle 236 includes an end portion 258 and opposite end portion 260. The shuttle 236 includes a bore 280 having a shoulder 294. A ball check valve assembly 283 includes a ball 284 that is held in place against a valve seat 288 by spring 286 which rests against the shoulder 294. The valve seat 288 threadably engages the shuttle at shuttle threads 292 and seat threads 290.

When the valve 210 is in vent position, as is shown by the flow arrows in FIG. 7, the spring 286 holds the ball 284 against the valve seat 288 to prevent fluid flow to the supply port 234. The end portion 258 has an O-ring groove 61 formed therein. An O-ring 62 is positioned in the O-ring groove 61 creating a seal between the adapter 248 and the shuttle 236. Thus, when the valve 210 is in the vent position as shown, in FIG. 7 no fluid flows to supply because of the seal achieved by the O-ring 62 with adapter 248 and the ball check valve assembly 283. However, when the valve 210 is in the open position, fluid pressure acting on the ball overcomes the spring force moving the ball away from the seal and allowing fluid to flow from supply to the BOP. The O-ring 62 makes a seal with adapter 248 to prevent fluid from escaping to vent when the valve is in the open position. The metal valve seat 102 and the metal sealing surface 100 on end portion 260 achieve a seal between the shuttle 236 and the adapter 250, to likewise prevent fluid from escaping to vent when the valve is in the open position.

The diameter of the end portion 258 is larger than the diameter of end portion 260. This step in diameter produces greater area on the supply end 258. When the shuttle 236 is in the open position, and the BOP piston 20 has reached full travel stopping flow and equalizing the pressure across the shuttle, a difference in force is created by this greater area on the supply end portion 258 holding the shuttle in the open position. Applicants have determined that a metal to metal seal can be achieved if the area of end portion 258 is approximately 1.5 times greater than the area of the end portion 260; however, other area ratios maybe suitable, provided that a good seal is achieved when the valve is in the open position.

Figure 8:
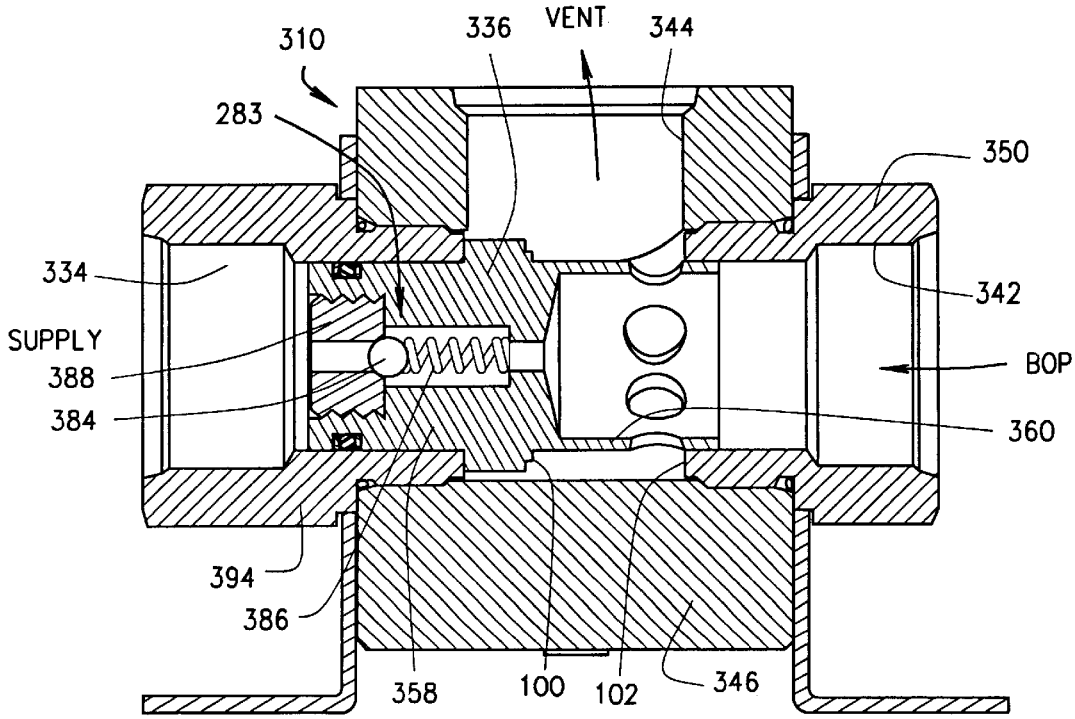
FIG. 8 is a second alternative embodiment of the dump valve of the present invention including a ball check valve. Both sides of the shuttle are the same diameter. The spring in the ball check valve creates a differential pressure across the shuttle and the force necessary to energize the metal seal.

FIG. 8 illustrates a second alternative embodiment of the dump valve which includes the ball check assembly 283, and including supply, vent and BOP ports of essentially the equal diameter. The body 346 defines the vent port 344, and the adapters 350 and 394 define the BOP port 342 and the supply port 334 respectively. The ball check valve assembly 283 includes a ball 384, a spring 386 and a valve seat 388.

The metal valve seat 102 and the sealing surface 100 on the end portion 360 of shuttle 336 achieve a seal between the shuttle 336 and the adapter 350, to prevent fluid from escaping to vent when the valve is in the open position.

The shuttle 336 has end portion 358 and opposite end portion 360 of approximately equal diameters. When in the open position, the spring 386 in the ball check valve results in the pressure on the supply side of the shuttle 336 to be greater than the pressure on the BOP side of the shuttle, resulting in a force pushing the shuttle 336 against the BOP adapter 350, and effecting a seal between the tapered sealing surface 100 and the metal valve seat 102.

Figure 9:
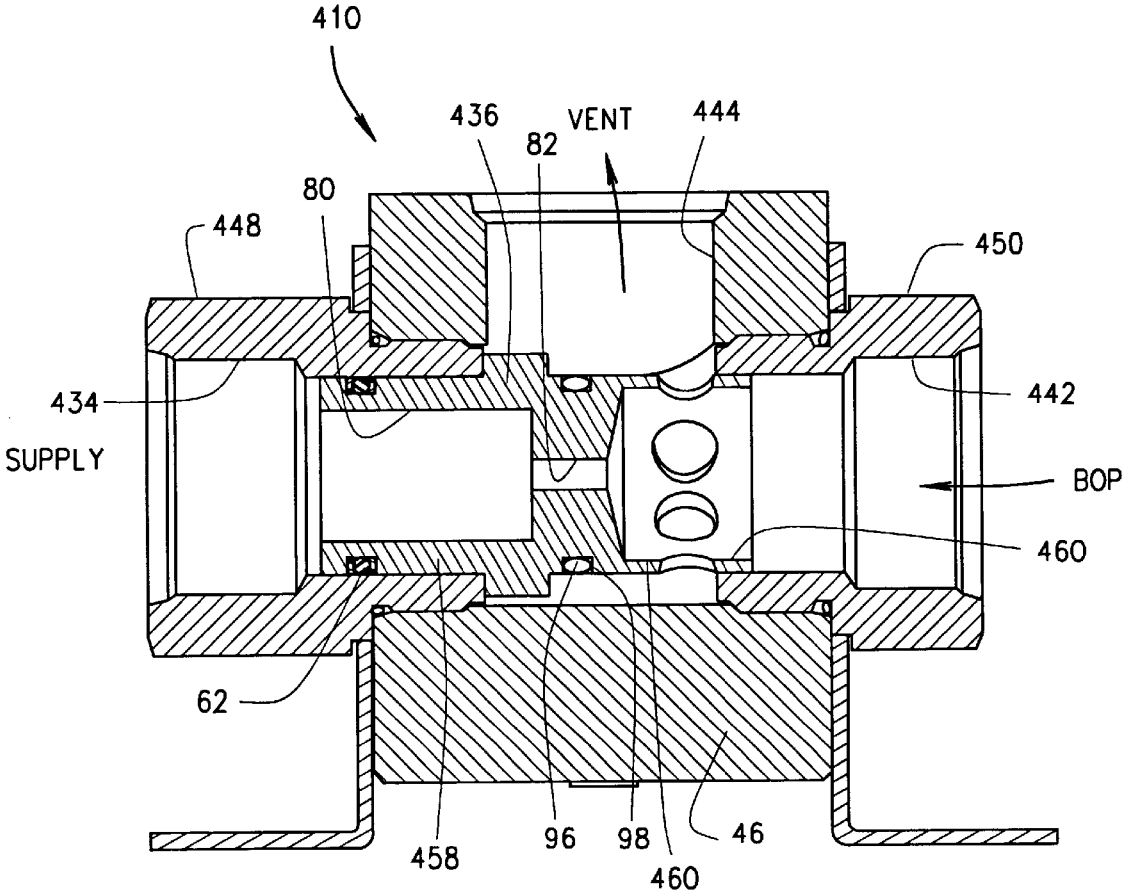
FIG. 9 is a third alternative embodiment of the dump valve of the present invention having soft seals. Both sides of the shuttle have approximately the same diameter. Axial force is not required to energize these seals as in the previously described embodiment.

FIG. 9 is a third alternative embodiment of the dump valve. The valve 410 is constructed in the same manner as the valve of FIGS. 3–5, with the exception of the shuttle, the relative port diameters and the soft seal assembly. The shuttle 436 has end portion 458 and opposing end portion 460. End portion 458 engages supply adapter 448. End portion 460 engages BOP adapter 450. Adapters 448 and 450 are of equal size and shape. In FIG. 9 the metal to metal seal illustrated in FIG. 6 is replaced by a soft seal created by O-ring 96 which is located in channel 98 of the shuttle 436. Further, the diameters of the supply port 434, vent port 444 and BOP port 442 are all the same diameter, which may be advantageous for particular applications. The type of seals employed do not require axial force to be energized as in the previous embodiments discussed.

The shuttle 436 has end portion 458 and opposing end portion 460, both of which are of approximately equal diameter. Thus, the forces exerted by the fluid on the shuttle 436 are balanced when the shuttle 436 is in the vent position of FIG. 9 and the open position, not shown. As previously discussed, the type of seal is a matter of manufacturing convenience. The valve 410 uses two soft seals, i.e., the O-ring 96 and the O-ring 62. As a matter of manufacturing choice, other types of seals could also be employed. A check valve could also be utilized in this concept if desired.

Having described the invention in detail, those skilled in the art will appreciate that modifications may be made of the invention without departing from its spirit and scope. Therefore, it is not intended that the scope of the invention be limited to the specific embodiments described. Rather, it is intended that the scope of the invention be determined by the appended claims and their equivalents.

What is claimed is:

1. An improved quick dump valve comprising:

a body having a central longitudinal bore with first and second opposing ends, the first end being configured to receive and secure a supply port adapter, the second end being configured to receive and secure a BOP port adapter, the body further including a transverse bore in fluid communication with the central longitudinal bore, the transverse bore defining a vent port;

the supply port adapter defining a supply port and the BOP port adapter defining a BOP port;

a shuttle having first and second ends with a longitudinal central bore extending from the first end to the second end, the longitudinal central bore including a reduced diameter flow restrictor;

a seal between the first end of the shuttle and the supply port adapter and a seal between the second end of the shuttle and the BOP port adapter;

the first end of the shuttle being of a larger diameter than the second end; and the shuttle being adapted to slidably reciprocate in the body central bore from a vent position where the shuttle first end is in sealing contact with the supply port adapter, to an open position where the shuttle first end is in sealing contact with the supply port adapter and the shuttle second end is in sealing contact with the BOP port adapter; whereby upon increased fluid pressure in the BOP port causes the shuttle to slide towards the supply port adapter into the vent position, thereby allowing a plurality of shuttle apertures to come into fluid communication with the transverse bore, allowing fluid to flow from the BOP port to the vent port, and whereby upon increased fluid pressure in the supply port adapter causes the shuttle to slide towards the BOP port adapter into the open position, thereby removing the shuttle apertures from fluid communication with the transverse bore to allow fluid to flow from the supply port, through the longitudinal central bore of the shuttle, the reduced diameter flow restrictor, and into the BOP port.

2. The apparatus of claim 1, wherein the seal between the first end of the shuttle and the supply port adapter is elastomeric and the seal between the second end of the shuttle and the BOP port adapter is metal to metal.

3. An improved quick dump valve comprising:

a body having a central longitudinal bore with first and second opposing ends, the first end being configured to receive and secure a supply port adapter, the second end being configured to receive and secure a BOP port adapter, the body further including a transverse bore in fluid communication with the central longitudinal bore, the transverse bore defining a vent port;

the supply port adapter defining a supply port and the BOP port adapter defining a BOP port;

a seal between the first end of the shuttle and the supply port adapter and a seal between the second end of the shuttle and the BOP port adapter;

a shuttle having first and second ends with a longitudinal central bore between the shuttle first end and second end;

the first end of the shuttle engaging the supply port adapter and the second end engaging the BOP port adapter, the second end including a plurality of apertures, the shuttle being adapted to slidably reciprocate in the body central bore from a vent position where the shuttle first end is in sealing contact with the supply port adapter to an open position where the shuttle first end is in sealing contact with the supply port adapter and the shuttle second end is in sealing contact with the BOP adapter; and whereby upon increased fluid pressure through the BOP port the shuttle slides towards the supply port adapter into the vent position, thereby allowing the shuttle apertures to come into fluid communication with the transverse bore, allowing fluid to flow from the BOP port to the vent port, and whereby upon increased fluid pressure in the supply port the shuttle slides towards the BOP port adapter into the open position, thereby removing the shuttle apertures from fluid communication with the transverse bore to allow fluid flow from and through the supply port, through the longitudinal central bore of the shuttle through the flow restrictor, and to and through the BOP port adapter.

4. The apparatus of claim 3, wherein the seal between the first end of the shuttle and the supply port adapter is elastomeric and the seal between the second end of the shuttle and the BOP port adapter is elastomeric.

5. An improved BOP operating system having a BOP stack with open ports and close ports and hydraulically controlled rams adapted to move from an open position to a close position, wherein the improvement comprises: a plurality of quick dump valves proximate the open ports of the BOP stack, whereby the quick dump valve reduces the incidence of hydraulic shock, vibration and hose collapse and reduces the time necessary to move the shear rams from the open position to the close position, wherein the quick dump valve comprises:

a body having a central longitudinal bore with first and second opposing ends, the first end being configured to receive and secure a supply port adapter, the second end being configured to receive and secure a BOP port adapter, the body further including a transverse bore in fluid communication with the central longitudinal bore, the transverse bore defining a vent port;

the supply port adapter defining a supply port and the BOP port adapter defining a BOP port;

a shuttle having first and second ends with a longitudinal central bore extending from the first end to the second end, the longitudinal central bore including a reduced diameter flow restrictor;

a seal between the first end of the shuttle and the supply port adapter and a seal between the second end of the shuttle and the BOP port adapter;

the first end of the shuttle being of a larger diameter than the second end; and the shuttle being adapted to reciprocate in the body central bore from a vent position where the shuttle first end is in sealing contact with the supply port adapter, to an open position where the shuttle first end is in sealing contact with the supply port adapter and the shuttle second end is in sealing contact with the BOP port adapter; whereby upon increased fluid pressure in the BOP port the shuttle slides towards the supply port adapter into the vent position, thereby allowing a plurality of shuttle apertures to come into fluid communication with the transverse bore, allowing fluid to flow from the BOP port to the vent port, and whereby upon increased fluid pressure in the supply port adapter the shuttle slides towards the BOP port adapter into the open position, thereby removing the shuttle apertures from fluid communication with the transverse bore to allow fluid to flow from and through the supply port, through the longitudinal central bore of the shuttle, the reduced diameter flow restrictor, and to and through the BOP port.

6. An improved BOP operating system having a BOP stack with open ports and close ports and hydraulically controlled rams adapted to move from an open position to a close position, wherein the improvement comprises: a plurality of quick dump valves proximate the open ports of the BOP stack, whereby the quick dump valve reduces the incidence of hydraulic shock, vibration and hose collapse and reduces the time necessary to move the shear rams from the open position to the close position, wherein the quick dump valve comprises:

a body having a central longitudinal bore with first and second opposing ends, the first end being configured to receive and secure a supply port adapter, the second end being configured to receive and secure a BOP port adapter, the body further including a transverse bore in fluid communication with the central longitudinal bore, the transverse bore defining a vent port;

the supply port adapter defining a supply port and the BOP port adapter defining a BOP port;

a seal between the first end of the shuttle and the supply port adapter and a seal between the second end of the shuttle and the BOP port adapter;

a shuttle having first and second ends with a longitudinal central bore between the shuttle first end and second end;

the first end of the shuttle engaging the supply port adapter and the second end engaging the BOP port adapter, the second end including a plurality of apertures, the shuttle being adapted to slidably reciprocate in the body central bore from a vent position where the shuttle first end is in sealing contact with the supply port adapter to an open position where the shuttle first end is in sealing contact with the supply port adapter and the shuttle second end is in sealing contact with the BOP adapter; and whereby upon increased fluid pressure through the BOP port the shuttle slides towards the supply port adapter into the vent position, thereby allowing the shuttle apertures to come into fluid communication with the transverse bore, allowing fluid to flow from the BOP port to the vent port, and whereby upon increased fluid pressure in the supply port the shuttle slides towards the BOP port adapter into the open position, thereby removing the shuttle apertures from fluid communication with the transverse bore to allow fluid flow from and through the supply port, through the longitudinal central bore of the shuttle through the flow restrictor, and to and through the BOP port adapter.

* * * * *

UNITED STATES PATENT AND TRADEMARK OFFICE

CERTIFICATE OF CORRECTION

PATENT NO. : 6,655,405 B2
DATED : December 2, 2003
INVENTOR(S) : Hollister et al.

It is certified that error appears in the above-identified patent and that said Letters Patent is hereby corrected as shown below:

Title page,
Item [73], Assignee, delete "Cilmore Valve Co." and replace with
-- Gilmore Valve Co. --

Signed and Sealed this

Third Day of February, 2004

JON W. DUDAS
*Acting Director of the United States Patent and Trademark Office*